US007040998B2

(12) United States Patent
Jolliffe et al.

(10) Patent No.: US 7,040,998 B2
(45) Date of Patent: May 9, 2006

(54) GOLF PUTTING GAME WITH MEANS FOR AUTOMATICALLY MONITORING THE MOVEMENT OF THE BALL

(75) Inventors: Steven P. Jolliffe, Eastcote (GB); David V. Jolliffe, Eastcote (GB); Geoffrey Emmerson, Eastcote (GB)

(73) Assignee: World Golf Systems, Ltd., Eastcote (GB)

( * ) Notice: Subject to any disclaimer, the term of this patent is extended or adjusted under 35 U.S.C. 154(b) by 0 days.

(21) Appl. No.: 10/169,691

(22) PCT Filed: Jan. 4, 2001

(86) PCT No.: PCT/GB01/00025

§ 371 (c)(1),
(2), (4) Date: Nov. 1, 2002

(87) PCT Pub. No.: WO01/49379

PCT Pub. Date: Jul. 12, 2001

(65) Prior Publication Data

US 2003/0125122 A1 Jul. 3, 2003

(30) Foreign Application Priority Data

Jan. 5, 2000 (GB) ..... 0000105.7

(51) Int. Cl.
*A63B 67/02* (2006.01)

(52) U.S. Cl. ..... 473/151; 473/153; 473/155; 473/405; 473/407; 473/409; 473/131

(58) Field of Classification Search ..... 463/1; 700/90–92; 473/131, 150–155, 165, 173–178, 473/180, 190, 192, 198–200, 351, 353, 385, 473/387, 405–407, 409, 196; 273/317.2, 273/108.2, 459–460, 182 A
See application file for complete search history.

(56) References Cited

U.S. PATENT DOCUMENTS

| | | | | |
|---|---|---|---|---|
| 4,673,183 A | | 6/1987 | Trahan | 273/176 |
| 5,487,542 A | * | 1/1996 | Foley | 473/153 |
| 5,582,550 A | | 12/1996 | Foley | 473/153 |
| 5,743,815 A | * | 4/1998 | Helderman | 473/353 |
| 5,860,648 A | * | 1/1999 | Petermeier et al. | 273/108.2 |
| 5,976,038 A | * | 11/1999 | Orenstein et al. | 473/467 |
| 6,113,504 A | * | 9/2000 | Kuesters | 473/353 |
| 6,270,433 B1 | * | 8/2001 | Orenstein et al. | 473/467 |
| 6,299,553 B1 | * | 10/2001 | Petuchowski et al. | 473/409 |

FOREIGN PATENT DOCUMENTS

| | | | |
|---|---|---|---|
| DE | 20009198.0 | | 5/2000 |
| FR | 2644354 A | * | 9/1990 |
| FR | 2751556 | | 1/1998 |
| WO | WO 99/48046 | | 9/1999 |
| WO | WO 01/02060 | | 1/2001 |

* cited by examiner

*Primary Examiner*—Scott Jones
(74) *Attorney, Agent, or Firm*—Sheridan Ross P.C.

(57) ABSTRACT

A golf game employing r.f-tag coded golf balls has a playing area with r.f. antennae located underneath to enable the number of strokes taken by a player to be counted. Separate antennae are provided for the tee area and hole, respectively, and the antennae around the hole are smaller to improve resolution. The antennae are connected to a computer which monitors successive moving and stationary phases of a golf ball to count the number of strokes taken by a player.

9 Claims, 1 Drawing Sheet

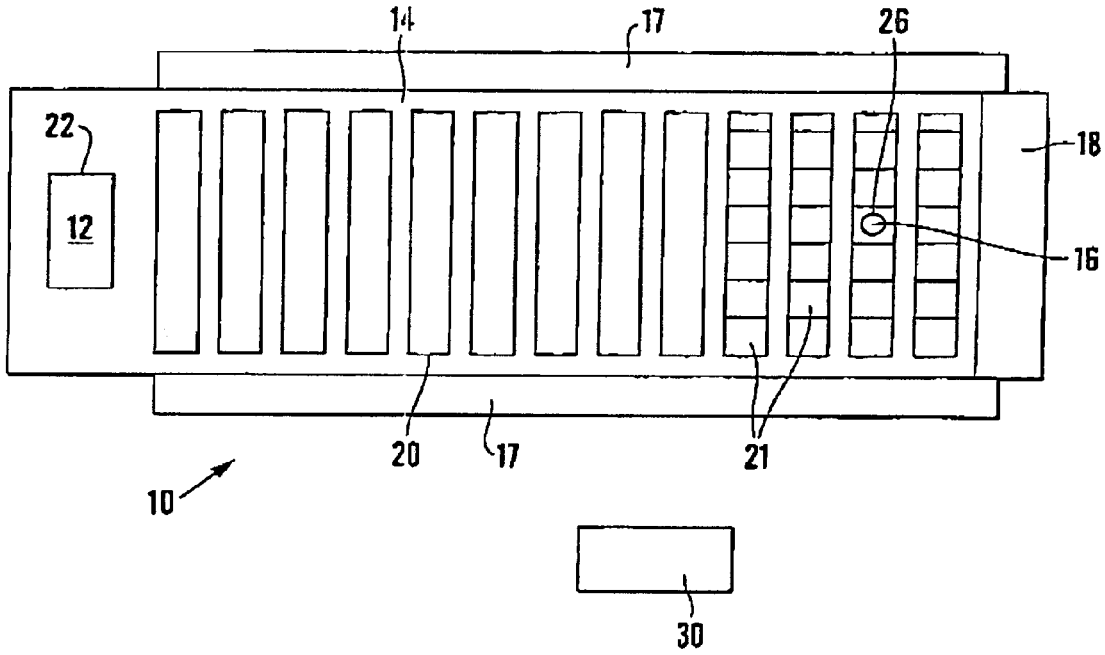
14
17
26
22
12
18
16
20
17
21
10
30

GOLF PUTTING GAME WITH MEANS FOR AUTOMATICALLY MONITORING THE MOVEMENT OF THE BALL

FIELD OF THE INVENTION

The present invention relates to a golf game and more particularly to a golf putting game with means for automatically monitoring the movement of the ball.

BACKGROUND OF THE INVENTION

A system for identifying golf balls is disclosed in co-pending international patent application WO 99/48046.

Scoring at putting is the same as on a golf course. Individual golfers have to record, usually by writing on paper, their scores for each hole. They then have to add up the scores, adjust the total depending on their handicap and work out their final score. This is time consuming, sometimes complicated and prone to error or cheating.

The process is made even more complicated if there is a team or 'league' competition involving several members in each team, all with different handicaps. In addition there are various methods to identify winners of competitions such as 'match play', 'stroke play', 'skins', 'most number of holes in one' etc.

The present invention seeks to overcome or reduce one or more of the above problems.

U.S. Pat. No. 5,582,550 discloses a putting game which uses golf balls each incorporating a low-powered transmitter and an antenna. Another antenna underneath each fairway detects each time when a club containing a permanent magnet strikes the ball. Signals from the fairway antennae are received by a central antenna connected to a stroke counter. A "ball-in-hole" magnet may produce a signal indicating the presence of a golf ball in the hole. The disclosure of this document corresponds to the introduction of claim 1. U.S. Pat. No. 4,673,183 discloses a golf game in which shots are taken from a single tee, the distance of a hit being detected by radar ground surveillance units. FR-A-2, 751,556 discloses a golf game in which coded balls are detected by antenna located at increasing distances from the tee area of a driving range.

SUMMARY OF THE PRESENT INVENTION

According to the present invention there is provided a golf game comprising golf balls, golf ball detecting means, a tee area, a playing area, and a control device, the golf balls incorporating identification means and with the golf ball detecting means located adjacent to the playing area, the detecting means being connected to the control device for counting the number of strokes, characterised in that the golf ball detection means comprises a plurality of golf ball detection members located at increasing distances from the tee area and the control device includes means for monitoring successive moving and stationary phases of the golf ball whether or not the ball has been intentionally struck so that the control device counts the number of strokes taken by a player.

The golf game is preferably a putting game.

The golf ball preferably contains a radio frequency identification (RFID) tag, such as that disclosed in co-pending patent application GB 9915331.4, and the detecting members comprise r.f.-antennae located under the surface of the playing area from the tee area to the hole. The tee area and the hole have separately-identifying antennae to indicate the start and end of each "hole". The control device is preferably arranged to be capable of detecting cheating and/or to detect whether one ball is knocked by another and to apply the appropriate penalty. In particular the golf game may comprise means for distinguishing between a ball being struck by a club when it is the player's turn and the ball being moved at other times.

The game may also comprise means for warning if a hole should not be played next.

DESCRIPTION OF THE DRAWINGS

A preferred embodiment of the present invention will now be described, by way of example only, with reference to the accompanying drawing, which shows a "hole" 10 of a golf putting course. A putting course would normally consist of nine or eighteen such holes.

DESCRIPTION OF PREFERRED EMBODIMENTS

Hole 10 comprises a tee area 12 from which golf balls are directed over a playing area of fairway 14 towards a hole 16. "Out of Bounds" areas are indicated at 17 and a hazard area is indicated at 18. The surface material can be artificial grass or real grass or any other suitable material.

Distributed along the playing area 14 are a plurality of r.f. antennae 20 connected by means of respective detectors or decoders (not shown) to a central computer (indicated schematically at 30) for the whole course. In order to prevent mutual interference between the antennae 20, they may be interrogated (i.e. switched on and off) periodically in such a way that no directly adjacent antennae are interrogated simultaneously. In the area of the hole 16, where ball movements are likely to be shorter, smaller antennae 21 are provided to improve resolution.

The tee area 12 has its own antenna 22 and the hole 16 has its own antenna 26. The same ball-identifying technology may be used as disclosed in application WO 99/48046.

The golf balls used each have a uniquely-coded tag or chip embedded therein to enable the individual balls to be accurately tracked by the computer. The balls also have a number and/or colour and/or other identification on their exterior so that players can visually distinguish them during a game.

The central computer 30 is connected to, or has its own, database which holds all the relevant data to maintain players' details, previous scores, handicaps, leagues etc. The players are initially identified by their membership card that contains their membership number linked to their personal details on the database. When a game(s) is purchased, a ball will be automatically identified by an RFID 'reader' and allocated, and given to the relevant individual.

By reading and processing signals obtained from the antennae 20 when interrogated, the central computer ascertains the following, as appropriate:

- the presence of a ball in play on the 'tee'
- the individual whose ball it is
- which hole he/she is playing
- how many times a ball is hit for each hole and the total score
- whether the player is in a hazard or 'out of play' and whether the player plays from the correct 'drop zone'
- how many players in each team
- the name of each player
- the player's handicap (automatically adjusted after each game)

the total score for each player
the type of game being played
the winner(s)
spot prize winners The score is kept by the computer 30 counting the number of times a particular ball is hit by tracking over distance and time. By knowing the whereabouts of a golf ball that is sometimes moving and sometimes stationary, an algorithm calculates the number of times a ball moves from one area to another (usually via several other areas) and therefore the number of times it has been struck. The speed of the ball is monitored at all times which, if required, could help prevent cheating. If a ball is knocked by another, the computer program is able to ascertain this and ensure that the appropriate rules are followed. If a ball in a null zone where there are no antennae, the computer 30 can still calculate where the ball is.

A computer screen is provided adjacent to each tee area 12 and/or hole 16 to display desired information, in particular to relay the scores to the relevant players.

The final hole 16 retains the golf ball for security purposes and ease of use.

An advantage of the above-described game is that the players can concentrate on the game itself without needing to keep the score. The use of unique codes on the RFID transponders in the golf balls ensures that they do not interfere with other RFID systems and that they cannot be copied by players in an unauthorised manner.

An advantage over the game of U.S. Pat. No. 5,582,550 is that strokes are identified by means of an algorithm employed to monitor motion of the ball rather than only by counting impacts of a club on the ball. This means that undesired movements of the ball can be detected, e.g. if it is knocked by another ball or is accidentally kicked.

Another advantage over U.S. Pat. No. 5,582,550 is increased resolution, there being an antenna for the tee, antennae along the fairway, and an increased concentration of antennae around the hole itself. Moreover the antennae may be interrogated periodically. Furthermore special clubs are not required and a player may use his/her own conventional clubs.

Various modifications can be made to the above-described game. An audible and/or visual alarm device may be provided adjacent each tee area (or incorporated with the computer screen). Where the "holes" are to be played in a particular order, the alarm indicates that a different "hole" should be played next. When the "holes" may be played in any order (e.g. to reduce queuing) the alarm indicates that the hole has already been played. In such a game, the computer instructs the ninth or eighteenth hole played, as appropriate, to retain the ball.

The RFID transponders may be active or passive and are arranged so that the orientation of the golf ball is irrelevant. This may be done by having two (or more) transponders within each golf ball, arranged at right angles to each other. Alternatively, the transponder can have a multiple aerial arrangement to achieve the same objective.

Apart from putting, the game may be played on any suitably modified golf course such as "pitch and putt" or crazy golf. If a suitably transparent playing surface is provided the balls can be detected optically.

The invention claimed is:

1. A golf game comprising
golf balls comprising identification means,
a tee area having a detecting member,
a playing area,
a control device comprising means for monitoring successive moving and stationary phases of a golf ball, and
golf ball detecting means comprising a plurality of golf ball detection members located at increasing distances from the tee area adjacent to the playing area, connected to the control device for counting the number of strokes
wherein, the control device detects the number of times a ball moves by tracking the ball over distance and time.

2. A golf game according to claim 1, further comprising a hole and wherein the golf balls contain radio frequency identification tags and the detecting member comprises r.f.-antennae located under the surface of the playing area from the tee area to a hole.

3. A golf game according to claim 2, wherein the hole has its own antenna.

4. A golf game according to claim 2, wherein antennae in the region of the hole are smaller than antennae under the remainder of the playing area.

5. A golf game according to claim 1 comprising means for warning if a hole should not be played next.

6. A golf game according to claim 1, wherein the control device comprises means for distinguishing between a ball being struck by a club when it is a player's turn and the ball being moved at other times.

7. A golf game comprising
golf balls incorporating identification means comprising radio frequency identification tags,
a tee area,
a playing area,
a hole,
a control device comprising means for monitoring successive moving and stationary phases of the golf ball,
golf ball detecting means connected to the control device for counting number of strokes and located adjacent to the playing area comprising radio frequency antennae located under a surface of the playing area from the tee area to the hole, and
a plurality of golf ball detection members located at increasing distances from the tee area,
wherein the control device detects a number of times a ball moves by tracking the ball over distance and time, and wherein the antennae are interrogated periodically, with no directly adjacent antennae being interrogated simultaneously.

8. A golf game comprising
a tee area,
a playing area,
a hole,
a golf ball incorporating identification means,
golf ball detecting means located adjacent to the playing area, and
a control device comprising means for monitoring successive moving and stationary phases of the golf ball, connected to the golf ball detecting means for counting the number of strokes,
wherein the golf ball detecting means comprises a plurality of golf ball detection members located at increasing distances from the tee area so that the control device detects the number of times a golf ball moves by tracking the golf ball over distance and time, and
wherein the golf ball contains radio frequency identification tags and the detecting members comprise r.f.-antennae located under the surface of the playing area from the tee area to a hole, and
wherein the tee area has its own antenna.

9. A golf game comprising a tee area, a playing area, a hole, a golf ball incorporating identification means, golf ball detecting means located adjacent to the playing area, and a control device comprising means for monitoring successive moving and stationary phases of the golf ball connected to the golf ball detecting means for counting the number of strokes, wherein the golf ball detecting means comprises a plurality of golf ball detection members located at increasing distances from the tee area so that the control device detects the number of times a golf ball moves by tracking the golf ball over distance and time, and wherein the golf ball contains radio frequency identification tags and the detecting members comprise r.f.-antennae located under the surface of the playing area from the tee area to a hole, and, wherein the antennae are interrogated periodically with no directly adjacent antennae being interrogated simultaneously.

* * * * *